US006683489B1

(12) United States Patent
Eker

(10) Patent No.: US 6,683,489 B1
(45) Date of Patent: Jan. 27, 2004

(54) METHODS AND APPARATUS FOR GENERATING A SUPPLY-INDEPENDENT AND TEMPERATURE-STABLE BIAS CURRENT

(75) Inventor: Mehmet M. Eker, Santee, CA (US)

(73) Assignee: Applied Micro Circuits Corporation, San Diego, CA (US)

( * ) Notice: Subject to any disclaimer, the term of this patent is extended or adjusted under 35 U.S.C. 154(b) by 35 days.

(21) Appl. No.: 09/965,971

(22) Filed: Sep. 27, 2001

(51) Int. Cl.[7] ..... G05F 1/10

(52) U.S. Cl. ..... 327/538; 327/540; 327/541

(58) Field of Search ..... 327/538, 540, 327/542, 322, 103, 512, 541, 543, 539; 323/315, 312, 313, 314

(56) References Cited

U.S. PATENT DOCUMENTS 4,059,793 A * 11/1977 Ahmed ..... 323/19
5,239,256 A * 8/1993 Yoshida ..... 323/313
5,469,111 A 11/1995 Chiu ..... 327/538
5,528,128 A * 6/1996 Melse ..... 323/313
5,568,045 A * 10/1996 Koazechi ..... 323/314
5,572,161 A * 11/1996 Myers ..... 327/538
5,594,633 A 1/1997 Asazawa ..... 363/73
6,038,115 A * 3/2000 Kleemeier et al. ..... 361/42
6,040,720 A 3/2000 Kosiec ..... 327/83
6,265,857 B1 7/2001 Demsky et al. ..... 323/312
6,278,266 B1 * 8/2001 Glasband ..... 323/355
6,466,081 B1 * 10/2002 Eker ..... 327/541
6,496,057 B2 * 12/2002 Wada et al. ..... 327/534

* cited by examiner

*Primary Examiner*—Kenneth B. Wells
*Assistant Examiner*—Hiep Nguyen
(74) *Attorney, Agent, or Firm*—Incaplaw; Terrance A. Meador

(57) ABSTRACT

A biasing circuit for producing a bias current which is supply-independent and temperature-stable includes a first voltage generating circuit which produces a first voltage $V_1$ at an output; a second voltage generating circuit which produces a second voltage $V_2$ different from the first voltage $V_1$ at an output; a differential amplifier circuit having inputs coupled to the outputs of the first and the second voltage generating circuits and producing a reference voltage $V_{REF}$ based on a difference between the first voltage $V_1$ and the second voltage $V_2$; and a current generating circuit which produces a bias current $I_{REF}$ from the reference voltage $V_{REF}$.

6 Claims, 4 Drawing Sheets

METHODS AND APPARATUS FOR GENERATING A SUPPLY-INDEPENDENT AND TEMPERATURE-STABLE BIAS CURRENT

BACKGROUND OF THE INVENTION

1. Field of the Invention

The present invention relates to methods and apparatus for generating a bias current which is supply-independent and temperature-stable.

2. Description of the Related Art

A biasing circuit for producing a bias current which is supply-independent and temperature-stable is critical to the success of most any analog circuit design. For most high-speed analog circuit designs, the bias current must also be maintained over a certain voltage signal swing.

In conventional biasing circuits, reference voltages and currents produced therefrom undesirably fluctuate due to, for example, temperature and integrated circuit (IC) process variations. A conventional biasing current changes not only with the resistor process (which is intentional and desired), but also with the transistor process. Variations from the resistor process are part of the design objective (for a constant swing which is equal to I*R), whereas variations from the transistor process are undesirable.

Advances in CMOS technology are primarily targeted to the design of digital circuits. The modeling of CMOS devices for their analog behavior in low current regions (sub-threshold and near-threshold operation) is inaccurate. Therefore, it becomes necessary to design analog circuits away from these regions to increase the design's reliability. This requirement translates into utilizing transistors with relatively large $V_{gs}$ values. As CMOS technology keeps scaling down, however, supply voltages keep getting lower. Thus, the low supply voltage limits the designer's options.

Accordingly, what are needed are methods and apparatus for generating a bias current which is supply-independent and temperature-stable.

SUMMARY OF THE INVENTION

According to the present invention, a biasing circuit for producing a bias current which is supply-independent and temperature-stable includes a first voltage generating circuit, a second voltage generating circuit, a differential amplifier circuit, and a current generating circuit.

The first voltage generating circuit produces a first voltage $V_1$ at its output, and the second voltage generating circuit produces a second voltage $V_2$ different from the first voltage $V_1$ at its output. The first voltage generating circuit includes a first transistor having a first temperature coefficient and a first aspect ratio. The second voltage generating circuit includes a second transistor having a second temperature coefficient that is substantially the same as the first temperature coefficient, and a second aspect ratio that is different from the first aspect ratio.

The differential amplifier circuit has inputs coupled to the outputs of the first and the second voltage generating circuits and produces a reference voltage $V_{REF}$ based on a difference between the first voltage $V_1$ and the second voltage $V_2$. The current generating circuit produces a bias current $I_{REF}$ from the reference voltage $V_{REF}$. Since the first and second voltages $V_1$ and $V_2$ change with temperature in the same way, and the reference voltage $V_{REF}$ is based on the difference between these voltages, the reference voltage $V_{REF}$ and bias current $I_{REF}$ have temperature coefficients that are zero or nearly zero. Thus, a bias current which is supply-independent and temperature-stable is produced.

DETAILED DESCRIPTION OF THE PREFERRED EMBODIMENTS

According to the present invention, a biasing circuit for producing a bias current which is supply-independent and temperature-stable includes a first voltage generating circuit, a second voltage generating circuit, a differential amplifier circuit, and a current generating circuit. The first voltage generating circuit produces a first voltage $V_1$ at its output, and the second voltage generating circuit produces a second voltage $V_2$ different from the first voltage $V_1$ at its output. The first voltage generating circuit includes a first transistor having a first temperature coefficient and a first aspect ratio. The second voltage generating circuit includes a second transistor having a second temperature coefficient that is substantially the same as the first temperature coefficient, and a second aspect ratio that is different from the first aspect ratio. The differential amplifier circuit has inputs coupled to the outputs of the first and the second voltage generating circuits and produces a reference voltage $V_{REF}$ based on a difference between the first voltage $V_1$ and the second voltage $V_2$. The current generating circuit produces a bias current $I_{REF}$ from the reference voltage $V_{REF}$. Since the first and second voltages $V_1$ and $V_2$ change with temperature in the same way, and the reference voltage $V_{REF}$ is based on the difference between these voltages, the reference voltage $V_{REF}$ and bias current $I_{REF}$ have temperature coefficients that are zero or nearly zero.

Figure 1:
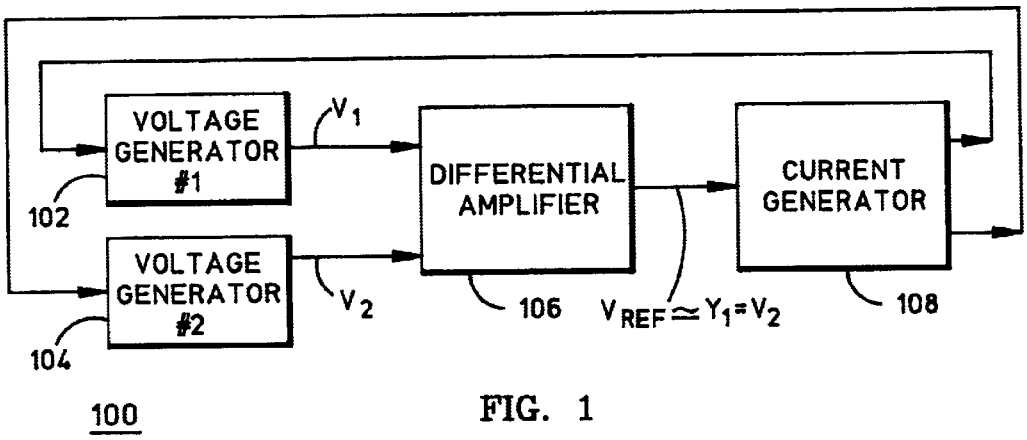
FIG. 1 is a block diagram of a biasing circuit in a first embodiment of the present invention.

FIG. 1 is a block diagram of a biasing circuit 100 in a first embodiment of the present invention. Biasing circuit 100 is typically embodied in an integrated circuit (IC) where a biasing current is supplied outside the IC at an output pin or alternatively used to bias internal circuitry. Biasing circuit 100 includes a voltage generating circuit 102, a voltage generating circuit 104, a differential amplifier 106, and a current generator circuit 108. Voltage generating circuit 102 produces a first voltage $V_1$ at its output, whereas voltage generating circuit 104 produces a second voltage $V_2$ that is different from the voltage $V_1$ at its output. Differential amplifier 106 has inputs coupled to the outputs of the voltage generating circuits 102 and 104 and produces a reference voltage $V_{REF}$ based on a difference between the first voltage $V_1$ and the second voltage $V_2$. Current generating circuit 108 produces a bias current based on the reference voltage $V_{REF}$. Outputs of current generating circuit 108 are fed back into voltage generating circuits 102 and 104.

Voltage generating circuits 102 and 104 include transistors for generating the voltages $V_1$ and $V_2$. More particularly, voltage generating circuit 102 has a first transistor with a first temperature coefficient, and voltage generating circuit 104 has a second transistor with a second temperature coefficient that is substantially the same as the first temperature coefficient. In addition, the first transistor of voltage generating circuit 102 has a first aspect ratio and the second transistor of voltage generating circuit 104 has a second aspect ratio that is different from the first aspect ratio. An aspect ratio of a transistor is the ratio of its channel width (W) to channel length (L), or W/L. The aspect ratios of the first and second transistors are made different by configuring the channel lengths in the first and the second transistors to be different.

Figure 2:
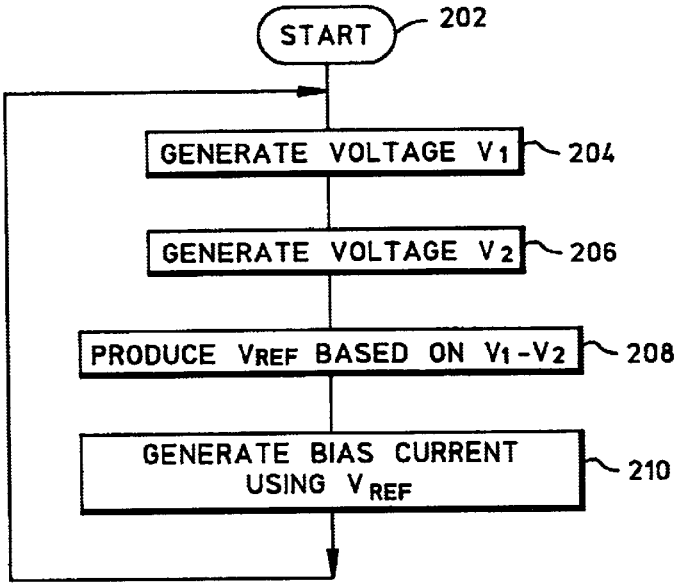
FIG. 2 is a flowchart of a method of generating a bias current which is supply-independent and temperature-stable.

FIG. 2 is a flowchart of a method of generating a bias current which is temperature-stable and supply-independent, which may be performed by biasing circuit 100 of FIG. 1. Beginning at a start block 202, a voltage $V_1$ is generated (step 204) and a voltage $V_2$ that is different from voltage $V_1$ is generated (step 206). Preferably, step 204 is performed utilizing a first transistor with a first temperature coefficient and step 206 is performed utilizing a second transistor with a second temperature coefficient that is substantially the same as the first temperature coefficient. The first transistor of step 204 also has a first aspect ratio, and the second transistor of step 206 has a second aspect ratio that is different from this first aspect ratio. Next in FIG. 2, a voltage $V_{REF}$ is produced based on a difference between the voltage $V_1$ and the voltage $V_2$ (step 208). Finally, a bias current $I_{REF}$ is produced from the voltage $V_{REF}$ (step 210). The flowchart repeats continually starting again at step 204.

Figure 3:
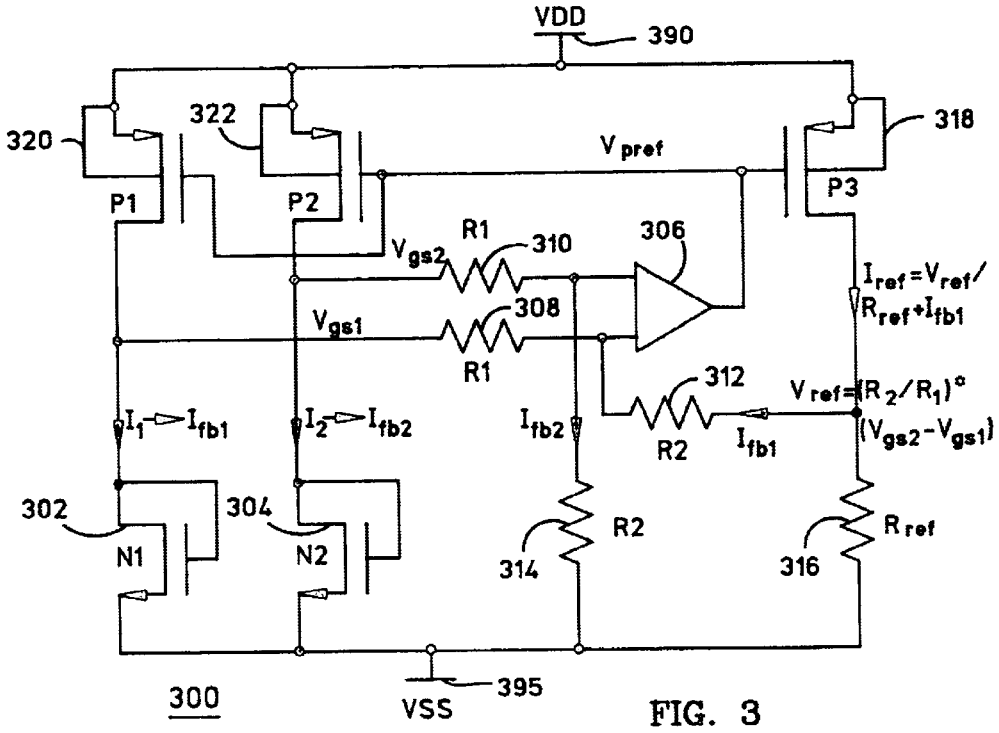
FIG. 3 is a schematic diagram of a biasing circuit in a second embodiment of the present invention.

FIG. 3 is a schematic diagram of a biasing circuit 300 in a second embodiment of the present invention, which is based on the block diagram of FIG. 1. Biasing circuit 300 is typically embodied in an IC where a biasing current is supplied at an output pin or alternatively used within the IC itself. Biasing circuit 300 has a first voltage generating circuit which includes a transistor 302; a second voltage generating circuit which includes a transistor 304; a differential amplifier which includes an operational amplifier 306 and resistors 308–314; a current generating circuit which includes a resistor 316 and a transistor 318; and current mirror circuitry which includes current mirror transistors 320–322. In this embodiment, biasing circuit 300 is configured to operate over a supply voltage range of 1.0–1.3 volts. All of the transistors are biased in their strong inversion region and operate in the saturation region all of the time.

In the embodiment of FIG. 3, transistors 302 and 304 are N-channel type metal-oxide-semiconductor field-effect transistors (MOSFETs) and transistors 318–322 are P-channel type MOSFETS. Transistor 302 has a drain coupled to a first reference voltage 390 ($V_{DD}$) through current mirror transistor 320, a source coupled to a second reference voltage 395 ($V_{SS}$), and a gate coupled to its own drain. Similarly, transistor 304 has a drain coupled to the first reference voltage 390 ($V_{DD}$) through current mirror transistor 322, a source coupled to the second reference voltage 395 ($V_{SS}$), and a gate coupled to its own drain.

Transistor 302 has a first temperature coefficient and transistor 304 has a second temperature coefficient that is substantially the same as the first temperature coefficient. In addition, transistor 302 is configured to have a first aspect ratio and transistor 304 is configured to have a second aspect ratio that is different from the first aspect ratio. An aspect ratio of a transistor is the ratio of its channel width (W) to channel length (L), or W/L. Particularly, transistor 304 is configured to have a second channel length (second L) that is different from a first channel length (first L) of transistor 302.

The differential amplifier includes resistor 308 ($R_1$) having a first end coupled to the drain of transistor 302, resistor 310 ($R_1$) having a first end coupled to the drain of transistor 304, resistor 312 ($R_2$) having a first end coupled to a second end of resistor 308 ($R_1$), and resistor 314 ($R_2$) having a first end coupled to a second end of resistor 310 ($R_1$) and a second end coupled to the second reference voltage 395 ($V_{SS}$). Operational amplifier 306 has a first input (negative) coupled to the second end of resistor 310 ($R_1$) and a second input (positive) coupled to the second end of resistor 308 ($R_1$).

The current generating circuit includes resistor 316 ($R_{REF}$) having a first end coupled to a second end of resistor 312 ($R_2$) and a second end coupled to the second reference voltage 395 ($V_{SS}$). Preferably, resistor 316 ($R_{REF}$) has a zero temperature coefficient. The current generating circuit also includes transistor 318 having a gate coupled to an output of operational amplifier 306 and to gates of current mirror transistors 320 and 322; a source coupled to the first reference voltage 390 ($V_{DD}$); and a drain coupled to the first end of resistor 316 ($R_{REF}$).

A first voltage $V_{gs1}$ is produced at the first end of resistor 308 ($R_1$) and a second voltage $V_{gs2}$ is produced at the first end of resistor 310 ($R_1$). This first voltage $V_{gs1}$ is different from the second voltage $V_{gs2}$. A voltage $\Delta V_{gs}=(V_{gs2}-V_{gs1})$ is amplified by the differential amplifier to the level of a bias voltage $V_{REF}$ produced at the first end of resistor 316 ($R_{REF}$). Resistor 316 ($R_{REF}$) converts bias voltage $V_{REF}$ into a bias current $I_{REF}$ Transistor 318 samples this bias current $I_{REF}$, and current mirror transistors 320 and 322 mirror it and feed it back so that voltages $V_{gs2}$ and $V_{gs1}$ maintain their proper values.

Transistors 302 and 304 are configured to have different aspect ratios and different currents in order to maintain different voltages $V_{gs2}$ and $V_{gs1}$ but yet the same temperature coefficients. Since both transistors 302 and 304 have different voltages $V_{gs1}$ and $V_{gs2}$ that change with temperature in the same way, voltage $\Delta V_{gs}=(V_{gs2}-V_{gs1})$ and the bias voltage $V_{REF}$ have zero temperature coefficients. Since bias voltage $V_{REF}$ also has a zero temperature coefficient, bias current $I_{REF}$ is temperature-stable.

In one specific example of FIG. 3, first reference voltage 390 ($V_{DD}$)=1.2 volts, second reference voltage 395 ($V_{SS}$)= 0.0 volts, voltage $V_{gs1}$=0.5 volts, $V_{gs2}$=0.65 volts, $\Delta V_{gs}=(V_{gs2}-V_{gs1})$=0.15 volts, $V_{REF}$=0.7 volts, and $I_{REF}$=0.1 mA. The aspect ratio of transistor 302 is 3.1/0.6 and the aspect ratio of transistor 304 is 2.8/0.2. The actual value of the temperature coefficient of transistors 302 and 304 is not critical and may be any suitable value.

Note that currents that determine proper voltages $V_{gs2}$ and $V_{gs1}$ have components of currents $I_{fb1}$ and $I_{fb2}$ (shown in FIG. 3) which should be taken into account when sizing transistors 318, 320, and 322. The effect of these currents $I_{fb1}$ and $I_{fb2}$ can be reduced greatly if resistors 308–312 are chosen to be very large (e.g., over 200 K Ω) so that these currents can be ignored altogether.

Figure 4:
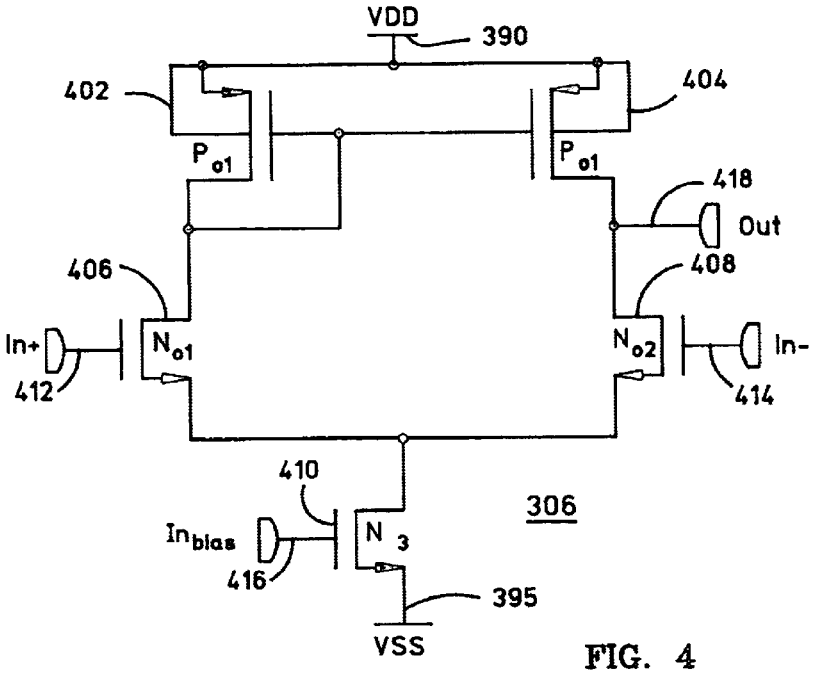
FIG. 4 is a schematic diagram of an operational amplifier of the biasing circuit of FIG. 3.

FIG. 4 is a schematic diagram of operational amplifier 306 of biasing circuit 300 of FIG. 3. Operational amplifier 306 includes transistors 402–410, where transistors 402 and 404 are P-channel type MOSFETs and transistors 406–410 are N-channel type MOSFETs. Transistor 402 has a source coupled to first reference voltage 390 (VDD) and a gate coupled to its own drain. Transistor 404 has a source coupled to first reference voltage 390 (VDD) and to the source of transistor 402, a gate coupled a gate of transistor 402, and a drain which forms an output 418 of operational amplifier 306. Transistor 406 has a gate which forms a positive input 412 to operational amplifier 306 and a drain coupled to the drain of transistor 402. Transistor 408 has a gate which forms a negative input 414 to operational amplifier 306, a drain coupled to the drain of transistor 404, and a source coupled to a source of transistor 406. Transistor 410 has a drain coupled to the sources of transistors 406 and 408, a source coupled to the second reference voltage 395 (VSS), and a gate which has a bias input 416 for biasing.

Operational amplifier 306 is preferred for its low power consumption and stability. As operational amplifier 306 utilizes a simple single stage, with all transistors 402–408 operating in their strong inversion region, it will have a low power consumption and is easier to compensate as transistor 318 (FIG. 3) and resistor 316 (FIG. 3) form the second stage for it.

Figure 5:
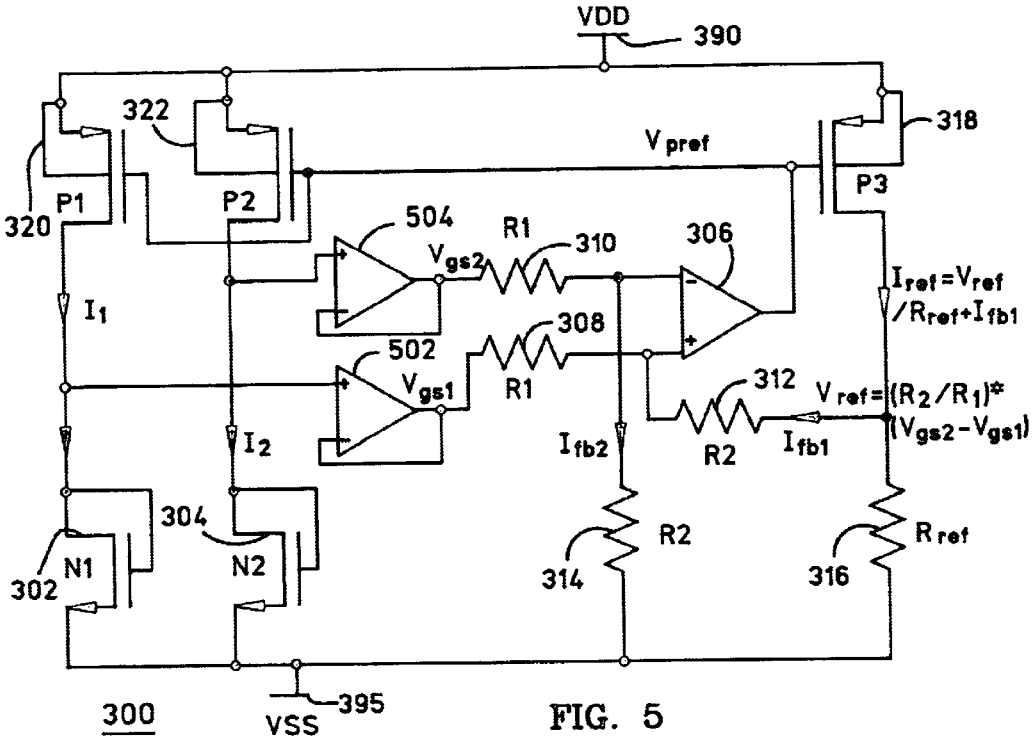
FIG. 5 is a schematic diagram of a biasing circuit in a third embodiment of the present invention.

FIG. 5 is a schematic diagram of a biasing circuit 300 (variation of biasing circuit 300 of FIG. 3) in a third embodiment of the present invention. Biasing circuit 300 of FIG. 5 is substantially the same as biasing circuit 300 of FIG. 3, except that biasing circuit 300 of FIG. 5 includes two additional operational amplifiers 502 and 504. Operational amplifiers 502 and 504 serve as voltage followers in biasing circuit 300 of FIG. 5. Operational amplifier 502 has a positive input coupled to the drains of transistors 302 and 320 and an output coupled to the first end of resistor 308 (R1) and to its own negative input. Similarly, operational amplifier 504 has a positive input coupled to the drains of transistors 304 and 322 and an output coupled to the first end of resistor 310 (R1) and to its own negative input.

Biasing circuit 300 of FIG. 5 is preferred where smaller values of resistors 308–312 are desired (e.g., to consume less chip "real estate"). Here, the reference voltages are determined only by currents $I_1$ and $I_2$ (see FIG. 5) and the total value of $R_1$ and $R_2$ can be much smaller than 200 K Ω. For example, $R_1$ and $R_2$ values may be chosen to be within the range of 5 K–25 K Ω. Transistor 318 is sized larger than transistors 320 and 322 since it conducts additional current $I_{b1}$, which can be much larger than in biasing circuit 300 of FIG. 3.

Figure 6:
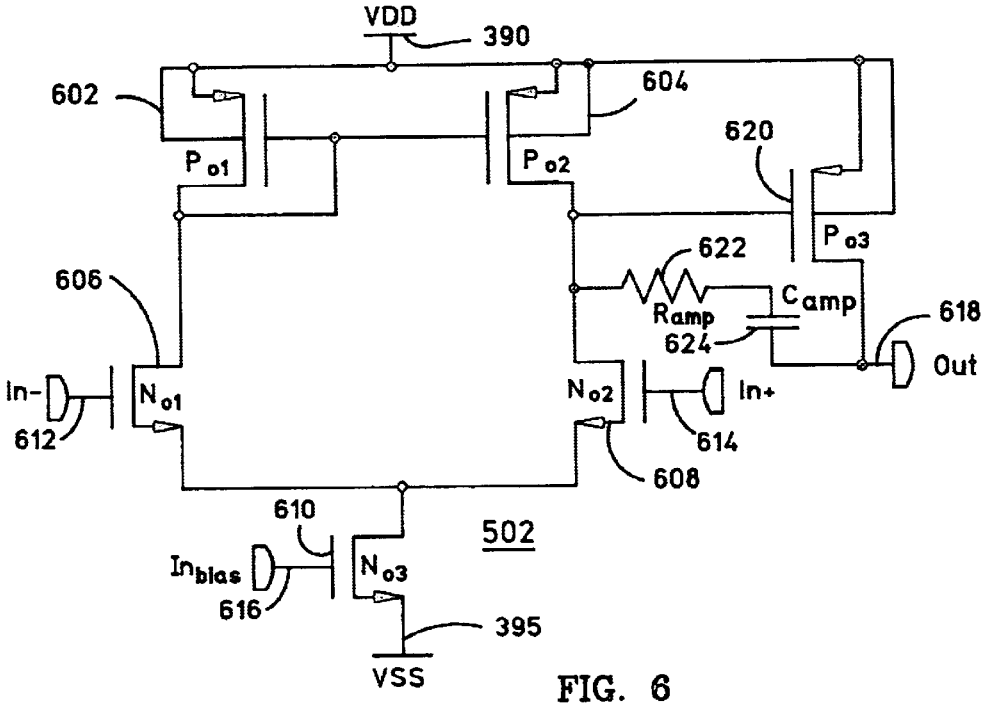
FIG. 6 is a schematic diagram of an operational amplifier of the biasing circuit of FIG. 5.

FIG. 6 is a schematic diagram of an operational amplifier 502 of biasing circuit 300 of FIG. 5. Operational amplifier 502 includes transistors 602–610 and 620, a resistor 622, and a capacitor 624. Transistors 602, 604, and 620 are P-channel type MOSFETs and transistors 606–610 are N-channel type MOSFETs. Transistor 602 has a source coupled to first reference voltage 390 ($V_{DD}$) and a gate coupled to its own drain. Transistor 604 has a source coupled to first reference voltage 390 ($V_{DD}$) and to the source of transistor 602, and a gate coupled a gate of transistor 602.

Transistor 606 has a gate which forms a negative input 612 to operational amplifier 502 and a drain coupled to the drain of transistor 602. Transistor 608 has a gate which forms a positive input 614 to operational amplifier 502, a drain coupled to the drain of transistor 604, and a source coupled to a source of transistor 606. Transistor 610 has a drain coupled to the sources of transistors 606 and 608, a source coupled to the second reference voltage 395 ($V_{SS}$), and a gate which has a bias input 616 for biasing. Transistor 620 has a source coupled to the first reference voltage 390 ($V_{DD}$), a gate coupled to the drain of transistor 604, and a drain which forms an output 618 of operational amplifier 502. Resistor 622 has a first end coupled to the drain of transistor 604 and a second end coupled to capacitor 624, which has a second end coupled to the drain of transistor 620.

Figure 7:
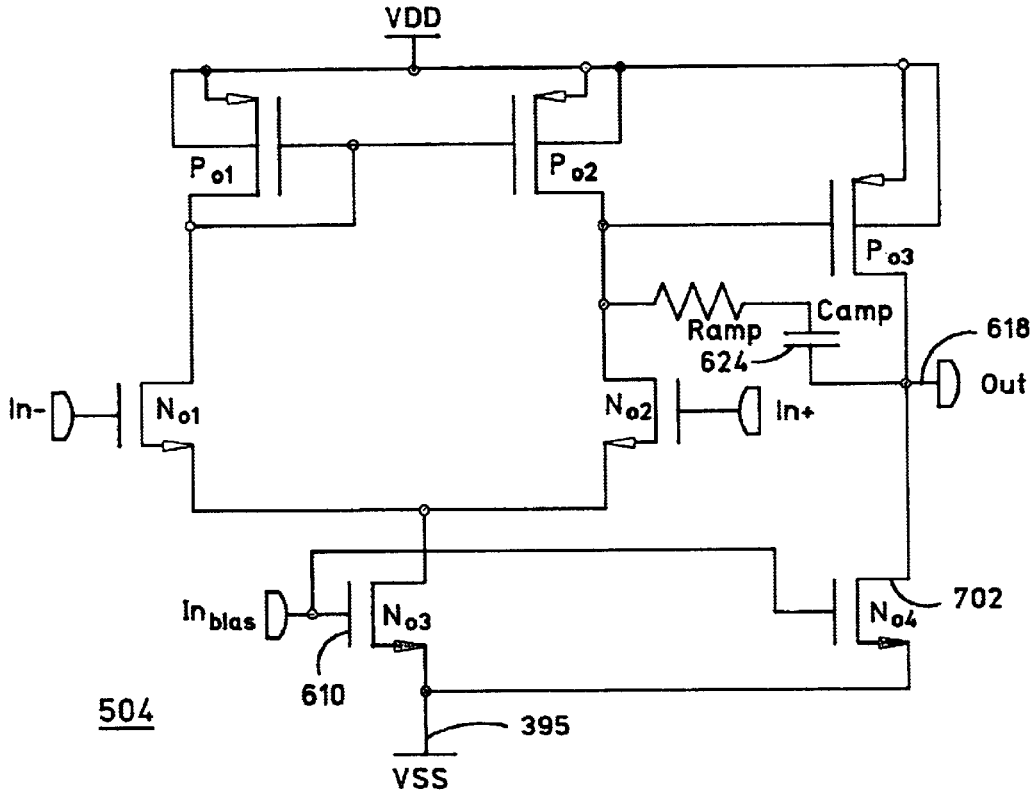
FIG. 7 is a schematic diagram of another operational amplifier of the biasing circuit of FIG. 5.

FIG. 7 is a schematic diagram of the other operational amplifier 504 of biasing circuit 300 of FIG. 5. Operational amplifier 504 of FIG. 7 is substantially the same as operational amplifier 502 of FIG. 6, except that operational amplifier 504 of FIG. 7 includes an additional transistor 702. Transistor 702 has a gate coupled to the gate of transistor 610, a drain coupled to the second end of capacitor 624 (at output 618), and a source coupled to the second reference voltage 395 ($V_{SS}$).

As with operational amplifier 306 of FIG. 4, operational amplifiers 502 and 504 of FIGS. 6–7 are preferred for their low power consumption and stability. As operational amplifiers 502 and 504 utilize a simple single stage, with all transistors operating in their strong inversion region, it will have a very low power consumption and is easier to compensate as transistor 318 (FIG. 5) and resistor 316 (FIG. 5) form the second stage for it.

For biasing circuits 300 of FIGS. 3 and 5, the temperature coefficient of $V_{gs1}$ and $V_{gs2}$ can be manipulated as follows. To simplify the upcoming mathematical derivations, only "long channel" expressions for the drain current will be considered. The end result still applies to "short channel" devices, however, which will have increased complications in the extractions. The quadratic expression for the drain current is given by:

$$I_D = \frac{\mu_e \cdot C_{ox} \cdot W}{2 \cdot L} \cdot (V_{gs} - V_{th})^2 \tag{1}$$

If (1) is rearranged for $V_{gs}$:

$$V_{gs} = \sqrt{\frac{2 \cdot I_D \cdot L}{\mu_e \cdot C_{ox} \cdot W}} + V_{th} \tag{2}$$

The object is to find a condition where the current $I_D$ is constant over temperature. From biasing circuit 300, it is known that this condition exists when $\Delta V_{gs}$ is constant over temperature. Therefore, in the above expression for $V_{gs}$, $I_D$ is constant over temperature. The only other terms that change with temperature in the expression are $V_{th}$ and $\mu_e$. Each one of these variables has negative temperature coefficients. Fortunately, since $\mu_e$ is in the denominator, its negative temperature coefficient becomes positive for $V_{gs}$ so that the temperature coefficient of $V_{gs}$ can be manipulated.

The temperature effects on $V_{th}$ and $\mu_e$ for one particular MOSFET model can be given, for first order, as:

$$V_{th}(T) = V_{th}(T_{nom}) + \left(K_{T1} + \frac{K_{t1l}}{L_{eff}} + K_{T2} \cdot V_{bseff}\right) \cdot \left(\frac{T}{T_{nom}} 1\right) \text{ and} \tag{3}$$

$$\mu_0(T) = \mu_0(T_{nom}) \cdot \left(\frac{T}{T_{nom}}\right)^{\mu_{te}} \tag{4}$$

where

- $T_{nom}$ is the temperature at which the device parameters are extracted (in degrees Kelvin) (if the parameters were extracted, at 25° C., for example, then $T_{nom}$ would be 273.15+25=298.15° K.);
- $K_{T1}$ is the temperature coefficient for the threshold voltage;
- $K_{T2}$ is the body-bias coefficient of the threshold temperature effect;

$K_{t1l}$ is the channel length dependence of the temperature coefficient for the threshold voltage; and $\mu_{te}$ is the mobility temperature exponent.

Typical values for all of the above coefficients are mostly negative. Therefore, both $V_{th}$ and $\mu_e$ decrease with increasing temperature. Also, the relationship between $\mu_e$ and $\mu_0$ can be given as $$\mu_e = C_0 \cdot \mu_0$$

where $C_0$ is a bias and temperature-dependent coefficient. The temperature effects of $C_0$ can be ignored for first order analysis, as they are minor.

If all the temperature dependent terms in (2) are combined:

$$V_{gs} = V_{th}(T_{nom}) + \alpha_{th} \cdot \left(\frac{T}{T_{nom}} - 1\right) + \sqrt{\frac{2 \cdot I_D \cdot L}{C_0 \cdot \mu_0(T_{nom}) \cdot C_{ox} \cdot W}} \cdot \left(\frac{T}{T_{nom}}\right)^{-\frac{\mu_{te}}{2}} \tag{5}$$

$$\alpha_{th} = K_{T1} + \frac{K_{t1l}}{L_{eff}} + K_{T2} \cdot V_{bseff} \tag{6}$$

As can be seen, the temperature dependency of the last term in (5) changed direction. That is, the second term in (5) will still decrease with increasing temperature (as $\alpha_{th}$ is negative) whereas the third term in (5) will now increase with increasing temperature (as $\mu_{te}$ is also negative).

Thus, there is a condition where these terms will cancel each other out. In general, they can only cancel out each other completely at a given temperature. However, if the temperature is selected to be in the middle of the temperature range of interest, very good stability can be maintained over that temperature range. The condition for such temperature stability can be derived by taking the temperature derivative of (5) at the typical temperature, $T_{mid}$:

$$\left.\frac{\partial V_{gs}}{\partial T}\right|_{T=T_{mid}} = \frac{\alpha_{th}}{T_{nom}} - \frac{\mu_{te}}{2 \cdot T_{nom}} \cdot \sqrt{\frac{2 \cdot I_D \cdot L}{C_0 \cdot \mu_0(T_{nom}) \cdot C_{ox} \cdot W}} \cdot \left(\frac{T_{mid}}{T_{nom}}\right)^{-\left(1+\frac{\mu_{te}}{2}\right)} = 0 \tag{7}$$

The condition for the temperature stability at $T_{mid}$ therefore reduces to:

$$\alpha_{th} = \frac{\mu_{te}}{2} \cdot \sqrt{\frac{2 \cdot I_D \cdot L}{C_0 \cdot \mu_0(T_{nom}) \cdot C_{ox} \cdot W}} \cdot \left(\frac{T_{mid}}{T_{nom}}\right)^{-\left(1+\frac{\mu_{te}}{2}\right)} \tag{8}$$

Properly biasing and sizing the transistor will achieve this condition. In one configuration, a very good temperature stability was achieved over a temperature range of −40° C. to 130° C.

The above derivations show that the temperature coefficient of $V_{gs}$ can be easily manipulated by changing the geometry of the device. The goal, however, is not to completely eliminate this coefficient for a single $V_{gs}$ but rather to eliminate it for $\Delta V_{gs} = V_{gs2} - V_{gs1}$. Therefore, the above manipulation method is only used to ensure that $V_{gs1}$ and $V_{gs2}$ both have the same temperature coefficients.

It is important to note that, in general, $V_{gs}$ has a negative temperature coefficient when the transistor drain current density is from low to moderate. The temperature coefficient becomes positive only at high current densities. When it is zero or positive, however, the $V_{gs}$ is quite high. As a result, the single transistor reference generators of this type are not suitable for low supply applications. With $\Delta V_{gs}$ reference generators, the individual transistors (reference generators) do not need to be biased at high current densities and therefore a lower $V_{gs}$ is possible.

In conventional biasing circuits, the targeted reference voltages and/or currents change with integrated circuit (IC) process variations. The targeted reference current changes not only with the resistor process (which is intentionally done), but also with the transistor process. Variations from the resistor process are part of the design objective (for a constant swing which is equal to I*R), but variations from the transistor process are undesirable. Advantageously, the present invention limits the targeted reference current changes with transistor process variations, as the actual reference voltage used to generate the reference current is $V_{gs2} - V_{gs1}$, which tends to change much less than $V_{gs}$ itself.

It is to be understood that the above is merely a description of preferred embodiments of the invention and that various changes, alterations, and variations may be made without departing from the true spirit and scope of the invention as set for in the appended claims. None of the terms or phrases in the specification and claims has been given any special particular meaning different from the plain language meaning to those skilled in the art, and therefore the specification is not to be used to define terms in an unduly narrow sense.

What is claimed is:

1. A biasing circuit for producing a bias current which is supply-independent and temperature stable, comprising:

a first voltage generating circuit which produces a first voltage $V_1$ at an output, the first voltage generating circuit further including a first transistor having a first temperature coefficient and a first aspect ratio;

a second voltage generating circuit which produces a second voltage $V_2$ at an output, the second voltage $V_2$ being different from the first voltage $V_1$, the second voltage generating circuit further including a second transistor having a second temperature coefficient that is substantially the same as the first temperature coefficient and a second aspect ratio that is different from the first aspect ratio;

a differential amplifier circuit having a first input coupled to the first voltage generating circuit, a second input coupled to the second voltage generating circuit, and an output;

a first resistor having a first end connected to the first input, and a second end;

a second resistor having a first end connected to the second end of the first resistor, and a second end;

a reference resistor having a first end connected to the second end of the second resistor for receiving a reference voltage $V_{REF}$ and for converting the reference voltage to the bias current; and a current mirror circuit coupled to the first end of the reference resistor, the output of the differential amplifier, and to inputs of the first and the second voltage generating circuits.

2. The biasing circuit of claim 1, wherein the first transistor has a first channel length and the second transistor has a second channel length that is different from the first channel length.

3. The biasing circuit of claim 1, wherein the reference resistor has a zero temperature coefficient.

4. A biasing circuit, comprising:

a first transistor having:

a drain coupled to a first reference voltage $V_{DD}$ through a first current mirror transistor;

a source coupled to a second reference voltage $V_{SS}$;

a gate coupled to the drain;

a first temperature coefficient; and a first aspect ratio;

a second transistor having:

a drain coupled to the first reference voltage $V_{DD}$ through a second current mirror transistor;

a source coupled to the second reference voltage $V_{SS}$;

a gate coupled to the drain;

a second temperature coefficient that is substantially the same as the first temperature coefficient; and a second aspect ratio that is different from the first aspect ratio;

a differential amplifier having:

a first resistor having a first end coupled to the drain of the first transistor;

a second resistor having a first end coupled to the drain of the second transistor;

a third resistor having a first end coupled to a second end of the first resistor and a second end coupled to the second reference voltage $V_{SS}$;

a fourth resistor having a first end coupled to a second end of the second resistor; and an operational amplifier having a first input coupled to the second end of the first resistor and a second input coupled to the second end of the second resistor; and a current generating circuit including:

a reference resistor having a first end coupled to a second end of the fourth resistor and a second end coupled to the second reference voltage $V_{SS}$; and a transistor having:

a gate coupled to an output of the operational amplifier and to gates of the first and the second current mirror transistors;

a drain coupled to the first reference voltage $V_{DD}$; and a source coupled to the first end of the reference resistor.

5. The biasing circuit of claim 4, wherein a first voltage $V_1$ is produced at the first end of the first resistor and a second voltage $V_2$ is produced at the first end of the second resistor, the first voltage $V_1$ being different from the second voltage $V_2$.

6. The biasing circuit of claim 4, wherein a bias voltage $V_{REF}$ based on a difference between the first voltage $V_1$ and the second voltage $V_2$ is produced at the first end of the reference resistor.

* * * * *